United States Patent [19]

Longsworth et al.

[11] Patent Number: 4,567,943

[45] Date of Patent: Feb. 4, 1986

[54] PARALLEL WRAPPED TUBE HEAT EXCHANGER

[75] Inventors: Ralph C. Longsworth, Allentown; William A. Steyert, Center Valley, both of Pa.

[73] Assignee: Air Products and Chemicals, Inc., Allentown, Pa.

[21] Appl. No.: 627,958

[22] Filed: Jul. 5, 1984

[51] Int. Cl.[4] ..... F28D 7/02; F28F 13/14; F28F 13/08

[52] U.S. Cl. ..... 165/147; 62/514 JT; 165/169

[58] Field of Search ..... 165/164, 104, 140, 169, 165/146, 147, 156; 62/513, 514 R, 514 JT, 515; 219/301, 303, 304

[56] References Cited

U.S. PATENT DOCUMENTS

| | | | |
|---|---|---|---|
| 2,443,295 | 6/1948 | Bisch | 165/164 |
| 2,578,280 | 12/1951 | Barnard | 219/301 |
| 2,578,917 | 12/1951 | Bisch | 165/164 |
| 2,621,903 | 12/1952 | Cohler | 165/164 |
| 2,653,014 | 9/1953 | Sniader | 165/164 |
| 3,055,191 | 9/1962 | Dennis | 62/514 JT |
| 3,063,260 | 11/1962 | Dennis | 62/514 JT |
| 3,353,370 | 11/1967 | Patten et al. | 62/514 JT |
| 3,620,029 | 11/1971 | Longsworth | 62/6 |
| 3,749,155 | 7/1973 | Buffiere | 165/147 |
| 4,194,536 | 3/1980 | Stine et al. | 165/164 |
| 4,316,502 | 2/1982 | Sanborn et al. | 165/164 |
| 4,523,637 | 6/1985 | Abramo | 165/164 X |

OTHER PUBLICATIONS

W. M. Kays & A. L. London, Compact Heat Exchanger, 1964, pp. 8–9, 104–105, 62–63, 14–15.

C. E. Kalb & J. D. Seader, Fully Developed Viscous--Flow Heat Transfer in Curved Tubes with Uniform Wall Temperature, Aiche Journal, vol. 20, 1974, pp. 340–346.

*Primary Examiner*—Sheldon J. Richter

*Attorney, Agent, or Firm*—James C. Simmons; E. Eugene Innis

[57] ABSTRACT

A counter flow heat exchanger comprising a central low pressure return tube deformed intermediate its ends to enhance heat transfer capability wrapped by a high pressure tube to conduct fluid to an expansion device. Also disclosed are a method of increasing the heat transfer capacity of a tube bundle heat exchanger and a liquid helium temperature refrigerator or a reliquefier utilizing the heat exchanger.

9 Claims, 25 Drawing Figures

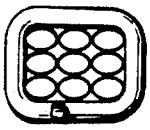
FIG. 11a
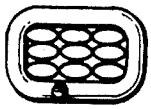
FIG. 11b
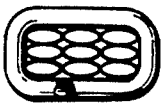
FIG. 11c
FIG. 12a
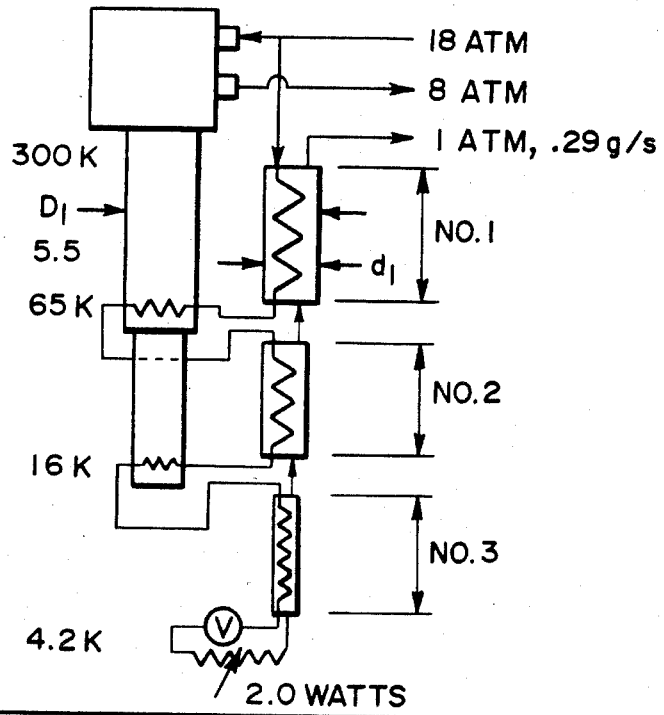
| HEAT EXCHANGER | 1 | 2 | 3 |
|---|---|---|---|
| DIAMETER, d (inches) | 2.00 | 2.00 | 1.00 |
| LENGTH (inches) | 14.38 | 10.63 | 10.50 |
| TUBE O.D. (inches) | 0.125 | 0.125 | 0.093 |
| FINNED TUBE O.D. (inches) | 0.25 | 0.25 | 0.181 |
| ENVELOPE DIAMETER, D | 5.5 | 5.5 | 1.0 |
| No. TRANSFER UNITS, NTU | 24.0 | 15.0 | 15.1 |
| $\Delta P_H$, psi | 7.2 | 1.0 | 0.4 |
| $\Delta P_L$, psi | 0.16 | 0.02 | 0.02 |

| HEAT EXCHANGER | $L_1$ | $L_2$ | $L_3$ |
|---|---|---|---|
| COIL DIAMETER (inches) | 3.3 | 3.3 | 2.6 |
| LENGTH (inches) | 3.1 | 3.3 | 3.1 |
| No. TRANSFER UNITS, NTU | 18.9 | 14.6 | 13.4 |
| $\Delta P_H$ psi | 1.1 | 0.5 | 0.1 |
| $\Delta P_L$ psi | 0.4 | 0.07 | 0.04 |

PARALLEL WRAPPED TUBE HEAT EXCHANGER

BACKGROUND OF THE INVENTION

This invention pertains to a Joule-Thomson heat exchanger terminating in a Joule-Thomson valve to produce refrigeration at 4.0° to 4.5° Kelvin (K) when used in conjunction with a source of refrigeration such as provided by a displacer-expander refrigerator.

BACKGROUND OF THE PRIOR ART

While a parallel wrapped tube heat exchanger of the device as disclosed herein is not shown in the art, the use of such a device with a displacer-expander refrigerator in conjunction with a Joule-Thomson heat exchanger for condensing liquid cryogen (e.g. helium) boil-off is disclosed in U.S. patent application Ser. No. 550,323, filed Nov. 9, 1983, now U.S. Pat. No. 4,484,458, the specification of which is incorporated herein by reference. In the aforementioned application, there is a discussion in the prior art of using a Joule-Thomson heat exchanger to condense liquid helium boil-off.

While the design of the aforementioned application was an improvement over the state of the art, there were still problems with heat transfer between the high and low pressure conduits of the heat exchanger, as well as between the heat exchanger and the refrigeration.

SUMMARY OF THE INVENTION

In order to improve the Joule-Thomson heat exchanger, it was discovered that the heat exchanger could be constructed by wrapping a single high pressure tube around a bundle of low pressure tubes and soldering the assembly. All of the tubes are either, continuously tapered, or are of reduced diameter or flattened in steps to optimize their heat transfer as a function of temperature. The heat exchanger according to the invention has a higher heat transfer efficiency, lower pressure drop and smaller size, thus making the device more economical than previously available heat exchangers. A heat exchanger, according to the present invention, embodies the ability to operate optimally in the temperature regime from room temperature to liquid helium temperature in a single heat exchanger.

A heat exchanger according to the present invention can be wound around a displacer-expander refrigerator, such as disclosed in U.S. Pat. No. 3,620,029, with the Joule-Thomson valve spaced apart from the coldest stage of the refrigerator in order to produce refrigeration at liquid helium temperatures, e.g. less than 5° Kelvin (K), down stream of the Joule-Thomson valve. The associated displacer expander refrigerator produces refrigeration at 15° to 20° K. at the second stage and refrigeration at 50° to 77° K. at the first stage. When the refrigerator is mounted in the neck tube of a dewar, the gas in the neck tube can transfer heat from the expander to the heat exchanger (or vice versa) and from the neck tube to the heat exchanger (or vice versa). If the temperature at a given cross section is not constant then heat can be transferred which adversly affects the performance of the refrigerator. By helically disposing the heat exchanger around the refrigerator, the temperature gradient in the heat exchanger can approximate the temperature gradient in the displacer-expander type refrigerator and the stratified helium between the coldest stage of the refrigeration and in the helium condenser, thus minimizing heat loss in the cryostat when the refrigerator is in use. The refrigerator can alternately be mounted in a vacuum jacket having a very small inside diameter.

BRIEF DESCRIPTION OF THE DRAWING

FIGS. 11A, 11B and 11C are cross-sectional views of the heat exchanger bundle of FIG. 11.

FIG. **12*a*** is a schematic of a refrigeration device utilizing a finned tube heat exchanger Joule-Thomson loop.

FIG. **12*b*** is a schematic of a two-stage displacer-expander refrigerator with a heat exchanger Joule-Thomson loop according to the present invention.

Figure 11:
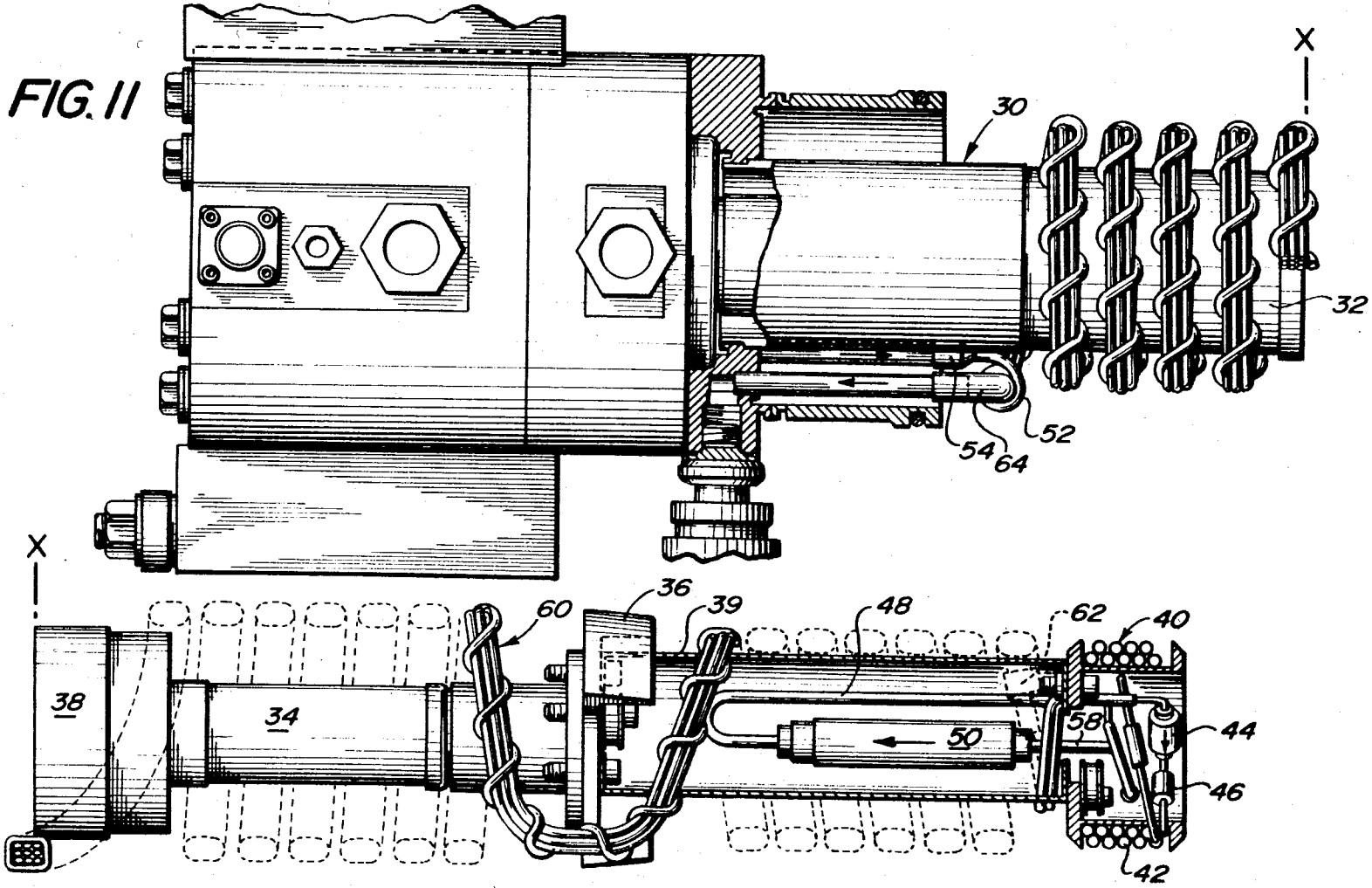
FIG. 11 is a front elevational view of the apparatus of the present invention in association with a displacer-expander type refrigerator.
Figure 13:
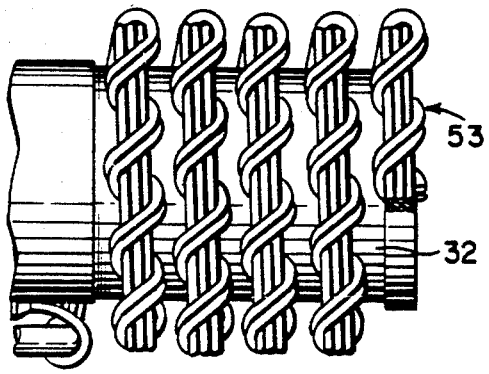

FIG. 13 is a partial fragmentary view of the upper portion of FIG. 11 showing the use of dual high pressure tubes.

Figure 14:
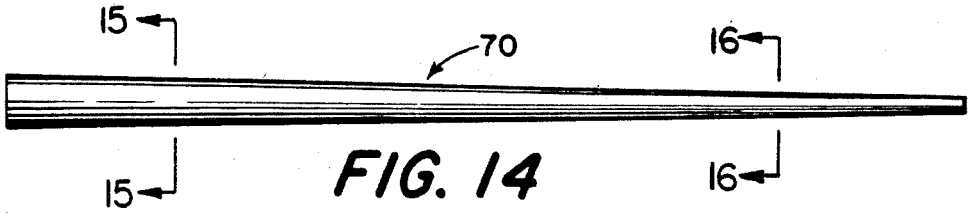

FIG. 14 is a front elevational view of a single high or low pressure tube according to one embodiment of the present invention.

Figure 15:
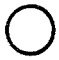

FIG. 15 is a cross-sectional view of the tube of FIG. 14 taken along lines 15—15 of FIG. 14.

Figure 1:
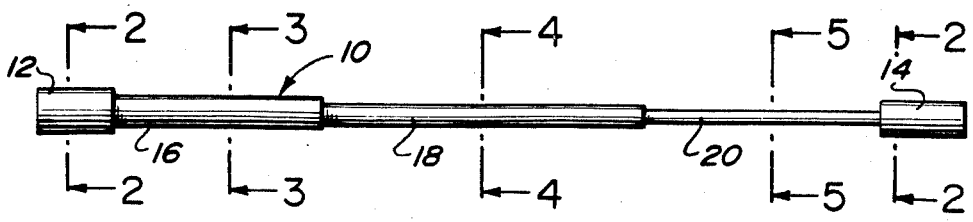
FIG. 1 is a front elevational view of a single tube according to one embodiment of the present invention.
Figure 16:
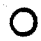

FIG. 16 is a cross-sectional view of the tube of FIG. 14 taken along lines 16—16 of FIG. 1.

Figure 17:
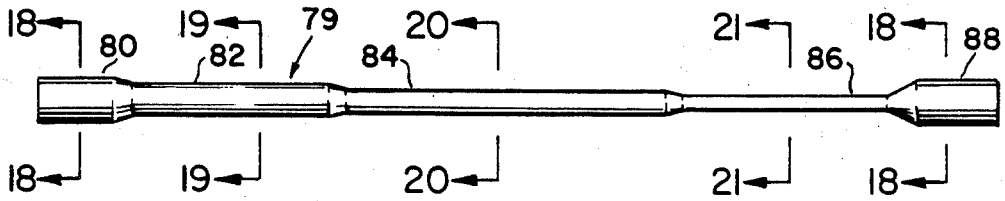

FIG. 17 is a front elevational view of a single high or low pressure tube according to the one embodiment of the present invention.

Figure 18:
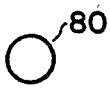

FIG. 18 is a cross-sectional view of the tube of FIG. 17 taken along lines 18—18 of FIG. 17.

Figure 19:
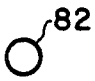

FIG. 19 is a cross-sectional view taken along line 19—19 of FIG. 17.

Figure 20:
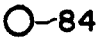

FIG. 20 is a cross-sectional view taken along line 20—20 of FIG. 17.

Figure 21:
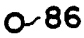

FIG. 21 is a cross-sectional view taken along line 21—21 of FIG. 17.

DETAILED DESCRIPTION OF THE PREFERRED EMBODIMENT

Figure 3:
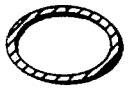
FIG. 3 is a cross-sectional view taken along line 3—3 of FIG. 1.
Figure 4:
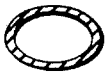
FIG. 4 is a cross-sectional view taken along line 4—4 of FIG. 1.
Figure 5:
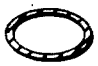
FIG. 5 is a cross-sectional view taken along line 5—5 of FIG. 1.
Figure 6:
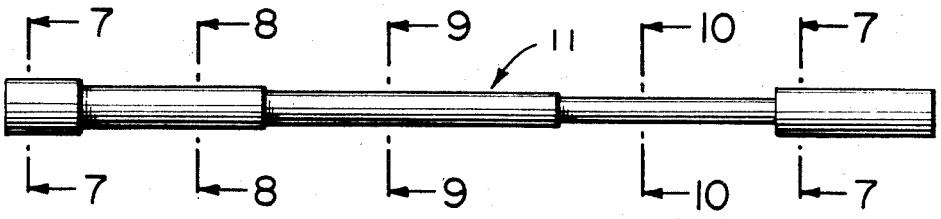
FIG. 6 is a front elevational view of a subassembly according to one embodiment of the present invention.
Figure 7:
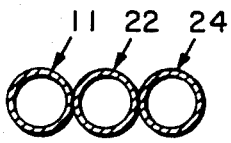
FIG. 7 is a cross-sectional view taken along lines 7—7 of FIG. 6.
Figure 8:
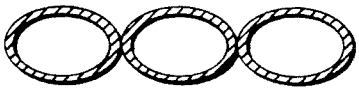
FIG. 8 is a cross-sectional view taken along line 8—8 of FIG. 6.
Figure 9:
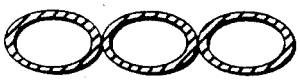
FIG. 9 is a cross-sectional view taken along line 9—9 of FIG. 6.
Figure 10:
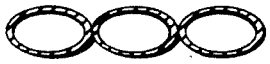
FIG. 10 is a cross-sectional view taken along line 10—10 of FIG. 9.

Referring to FIG. 1, there is shown a tube which is fabricated from a high conductivity material such as deoxidized, high residual phosphorus copper tubing. End 14 of tube 10 contains a uniform generally cylindrical section corresponding to the original diameter of the tube. Intermediate ends 12 and 14 are flattened sections 16, 18 and 20, respectively, having cross sections as shown in FIGS. 3, 4 and 5, respectively. The cross-sectional shape of section 16, 18 and 20 is generally elliptical with the short axis of the ellipse being progressively shorter in length from end 12 toward end 14 of tube 10. The lineal diameter of the various sections are shown by letters which dimensions will be set forth hereinafter.

In order to make a low pressure path for a heat exchanger, a plurality of tubes are flattened and then assembled into an array such as shown in FIGS. 6 through 10. Individual tubes such as tubes 11, 22 and 24 are prepared according to the tube disclosed in relation to FIGS. 1 through 5. The tubes 11, 22 and 24 are then assembled side by side and are tack soldered together, approximately six inches along the length to form a 3-tube array. Three-tube arrays are then nested to define a bundle of tubes 3 tubes by 3 tubes square which are tack soldered together.

The bundle of tubes such as an array of nine tubes is then bent around a mandrel and at the same time a high pressure tube is helically disposed around the bundle so that the assembled heat exchanger can be mated to a displacer-expander type refrigerator shown generally as 30 in FIG. 11. The refrigerator 30 has a first-stage 32 and a second stage 34 capable of producing refrigeration at 35° K. and above at the bottom of the first stage 32 and 10° K. and above at the bottom of the second stage 34. Second stage 34 is fitted with a heat station 36 and the first stage 32 is fitted with a heat station 38. Depending from the second stage heat station 36 is an extension 39 which supports and terminates in a helium recondenser 40. Helium recondenser 40 contains a length of finned tube heat exchanger 42 which communicates with a Joule-Thomson valve 44 through conduit 46. Joule-Thomson valve 44, in turn, via conduit 48, is connected to an adsorber 50, the function of which is to trap residual contaminants such as neon.

Disposed around the first and second stages of the refrigerator 30 and the extension 39 is a heat exchanger 60 fabricated according to the present invention. The heat exchanger 60 includes nine tubes bundled in accordance with the description above surrounded by a single high pressure tube 52 which is also flattened and which is disposed in helical fashion about the helically disposed bundle of tubes. The stepwise flattening of the nine tube bundle is illustrated in FIGS. 11A, 11B and 11C. High pressure tube 52 is connected via adapter 54 to a source of high pressure gas (e.g., helium) conducted to both the high pressure conduit 52 and the refrigerator. High Pressure gas passes through absorber 50 and tube 48 permitting the gas to be expanded in the Joule-Thomson valve 44 after which is exits through manifold 62 and the tube bundle and outwardly of the heat exchanger via manifold 64 where it can be recycled. High pressure tube 52 is flattened prior to being wrapped around the tube bundle to enhance the heat transfer capability between the high and low pressure tubes so that the high pressure gas being conducted to the JT valve is precooled.

A refrigerator according to FIG. 11 can utilize a heat station (not shown) in place of recondenser 40 so that the device can be used in a vacuum environment for cooling an object such as a superconducting electronic device.

According to one embodiment of the present invention, for a refrigerator having an overall length of the first and second stages and extension with condenser of 18 inches, tubes according to the following table can be fabricated.

TABLE

| Tube Array[1] | Length in Inches Per FIG. 11 (Diameter-inches)[2] | | | | |
|---|---|---|---|---|---|
| | A | B | C | D | L |
| Inner Bundle | 1 (0.93) | 43 (0.74) | 57 (.049) | 43 (.044) | 145 |
| Middle Bundle | 1 (0.93) | 46 (0.74) | 60 (.049) | 46 (.044) | 152 |
| Outer Bundle | 1 (0.93) | 48 (0.74) | 61 (.049) | 48 (.044) | 159 |
| High Pressure | 4 (0.93) | 112 (0.76) | 154 (.057) | 115 (.050) | 381 |

[1]Each bundle contains three tubes with the inner bundle being closest to refrigerator.
[2]Minor diameter of tubes before assembly.

Figure 12B:
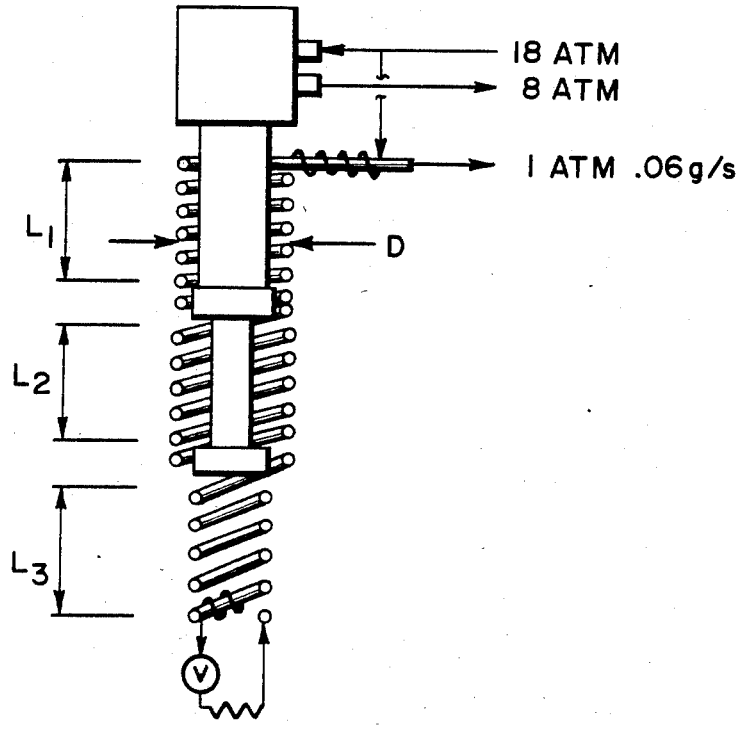

Two refrigerators, one fitted with a finned tube heat exchanger, such as shown schematically in FIG. 12*a*, and the other fitted with the heat exchanger according to the present invention, shown schematically in FIG. 12*b*, were constructed and tested. As shown in FIGS. 12*a* and 12*b*, for the same pressure of gas on the input and output side of both the refrigerator and the heat exchanger, the device according to the present invention resulted in comparable performance characteristics in a much more compact geometry.

In order to further understand the invention, the following methods were used to design the heat exchangers which have been fabricated and tested.

1. GAS PRESSURE DROP AND HEAT TRANSFER

Figure 2:
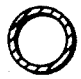
FIG. 2 is a cross-sectional view of the tube of FIG. 1 taken along lines 2—2 of FIG. 1.

The book, *Compact Heat Exchangers,* by W. M. Kays and A. L. London, McGraw Hill, N.Y., 1964 pp. 8–9, 104–105, 62–63, 14–15 describes methods to calculate pressure drop and heat transfer in heat exchangers. It does not, however, have data on flattened tubes; thus, the data on rectangular tubes were used. Relationships which were used are:

$$A = \frac{\pi}{2} a (D - a) + \frac{\pi}{4} a^2$$

$$De = Dh = 4A/\pi D$$

$$b = \frac{\pi}{2} (D - a) + \frac{a}{2}$$

where:

A—cross sectional area of the tube
D—inside diameter of the tube
De—effective diameter
Dh—hydraulic diameter
a—height of the flattened tube and height of the equivalent rectangular tube
b—width of the equivalent rectangular tube Kays and London show in FIGS. 1–2 of the treatise a generalized relationship of heat transfer vs. pumping energy per unit area for different heat exchanger geometries. The present invention falls in the upper left region of this graph corresponding to surfaces which have highest heat transfer and lowest pumping energy.

2. MATERIAL SELECTION

Heat must flow through the metal tubing and solder between the high and low pressure gas streams with a small temperature drop. On the other hand heat transfer along the heat exchanger should be poor. A compromise in the heat transfer characteristics of the metal is thus required.

For the temperature range from 300 to 4 K. DHP-122 copper (Deoxidized Hi-residual Phosphorus) is the preferred material for the tubing. The preferred solder has been found to be tin with 3.6% silver (Sn96) in the low temperature region and an ordinary lead-tin solder (60–40) for the high temperature region constituting about ⅔ of the heat exchanger. Sn96 solder is also used to attach the heat exchanger to the displacer expander heat stations.

3. CURVED TUBE EFFECT

Gas moving in curved tubes, rather than straight tubes, has a higher heat transfer coefficient. (See C. E. Kalb and J. D. Seader, *AICHE Journal,* V. 20, P. 340–346, (1974).) This results in a factor of 2 improvement in heat transfer performance at the warm (upper) end and a factor of about 1.5 at the lower end for exchangers which are designed according to the present invention.

4. DESIGN

To design a heat exchanger, assumptions are made regarding the number of tubes, their diameter, length, and height after flattening. All of the low pressure tubes are assumed to be equal. However, in the final coiled exchanger the inner layers have to be shorter than the outer layers to have all of the ends terminate together. There is a lot of latitude in sizing the high pressure tube, because the winding pitch can be varied to accommodate a wide variety of lengths. If the heat exchanger is to be coiled the desired diameter of the coil is usually known and held constant.

For the units which have been designed and built, the heat exchanger has been analyzed for three different temperature zones—300 to 60 K., 60 to 16 K. and 16 to 4 K. Average fluid properties are used in each zone. Heat transfer and pressure drop are calculated for a number of assumed geometrics. The geometry that has the best characteristics for the application is then selected. Since it is assumed that the heat exchanger is continuous from 300 to 4 K., the number of tubes and their diameter is held constant while the length of tubing in each zone and its amount of flattening are varied. The tubes are flattened more in the cold regions than the warm regions to compensate for changing fluid (helium) properties, increasing density, decreasing viscosity and decreasing thermal conductivity.

According to another embodiment of the invention the heat exchanger can be constructed wherein the tubes are drawn to a smaller diameter in the colder regions of the heat exchanger rather than being flattened to improve the heat exchanger. Round tubes are slightly less effective than flattened tubes in their heat transfer-pressure drop characteristics, but they do lend themselves to having equal length tubes in the low pressure bundle. This can be achieved in a coiled exchanger by twisting the low pressure bundle or periodically interposing tubes in a cable array in order to have all the equal length tubes terminate at the same points.

It is also within the scope of the present invention to utilize tubes that have a continuously tapering or flattened cross-section such as shown as 70 in FIG. 14 and as shown in cross-section at various locations in FIGS. 15 and 16.

The high pressure tube can be made as shown in FIG. 17 as 79 with end portions 80 and 88 and intermediate portions of reduced circular cross-section in a stepwise fashion as shown as 82, 84 and 86, respectively, in FIG. 17 and FIGS. 19 through 21.

Furthermore, the present invention encompasses the use of more than one high pressure tube; however, one tube is used in the preferred embodiment. The reason for this is that a single large diameter tube will have a larger flow area than multiple small diameter tubes; thus it is least sensitive to being blocked by contaminants. FIG. 13 shows the use of a plurality of high pressure tubes (53) wrapped around the low pressure tubes as set out above in regard to FIGS. 11, 11A, 11B and 11C. When blockage due to contaminants is a concern, then the designer favors the use of a larger diameter high pressure tube than might be required based only on heat transfer and pressure drop considerations. The tube has to be longer to compensate for its larger diameter and has to be wound around the low pressure tubes in a closer pitch.

We claim:

1. A heat exchanger of the type having a first confined path for conducting high pressure fluid to a point wherein said high pressure fluid is expanded to a lower pressure and a second confined path for returning the expanded fluid from the point of expansion comprising in combination:

a central low pressure flow path including at least one tube having a first or warm end and a second or cold end of generally circular cross-section with a plurality of deformed portions intermediate said ends deformed to exhibit a generally reduced cross-section said plurality of deformed portions being oval shaped with the minor diameter of said oval decreasing in length from said first end toward said second end, whereby said plurality of deformed portions of said tube enhances the heat exchange capability of said tube; and a second or outer flow path including at least one high pressure tube wrapped around said central tube in a helical fashion.

2. A heat exchanger according to claim 1 wherein said central low pressure flow path includes a plurality of tubes having first and second ends with a plurality intermediate sections of oval shape with different major and minor diameters.

3. A heat exchanger according to claim 1 wherein said central low pressure tube includes a plurality of sections successively reduced to a uniform diameter in each section.

4. A heat exchanger according to claim 3 wherein said sections of reduced diameter are arranged so that the diameters of each section are reduced progressively from a first end of said tube to a second end of said tube.

5. A heat exchanger according to claim 1 wherein said central low pressure tube is tapered from its first end to its second end.

6. A heat exchanger according to claim 1 wherein said second flow path includes a plurality of high pressure tubes.

7. A heat exchanger according to claim 1 herein said central low pressure flow path includes a plurality of tubes in a cable array.

8. A method of enhancing the heat transfer capability of individual tubes arranged in a bundle for defining the low pressure path for an expanded fluid moving from a cold region to a warm region comprising the step of reducing portions of the cross-section of said tubes intermediate the ends in the vicinity of the cold region of the tubes when heat transfer between said tubes and another object is required said cross-sectional reduction being done in stepwise fashion from one end to the other of each of said tubes at approximately the same location.

9. A method according to claim 8 wherein a high pressure tube is subjected to cross-sectional reduction along substantially its entire length and is wrapped around the bundle of tubes in a helical fashion.

* * * * *